US009962825B2

(12) United States Patent
Gonzales et al.

(10) Patent No.: US 9,962,825 B2
(45) Date of Patent: May 8, 2018

(54) MULTIFUNCTIONAL TOOLBOX

(71) Applicant: Stanley Black & Decker Inc., New Britain, CT (US)

(72) Inventors: Terry L. Gonzales, Middletown, CT (US); John C. Murray, Canton, CT (US); Megan E. McNeill, Norwalk, CT (US); Chih-Hung Chen, Taichung (TW); Tolga Caglar, Middletown, CT (US); Jin Chi Huang, Taichung (TW); Oaty A. Frye, Jr., Waterford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 9 days.

(21) Appl. No.: 14/851,032

(22) Filed: Sep. 11, 2015

(65) Prior Publication Data

US 2016/0075010 A1 Mar. 17, 2016

Related U.S. Application Data

(60) Provisional application No. 62/049,588, filed on Sep. 12, 2014.

(51) Int. Cl.

| | |
|---|---|
| ***B25H 3/02*** | (2006.01) |
| ***B25G 1/10*** | (2006.01) |
| ***B65D 25/28*** | (2006.01) |

(52) U.S. Cl.

CPC ..... *B25H 3/021* (2013.01); *B25G 1/102* (2013.01); *B25H 3/028* (2013.01); *B65D 25/28* (2013.01)

(58) Field of Classification Search

CPC ..... B25G 1/102; B25H 3/02; B25H 3/021; B25H 3/028; B65D 25/28

USPC ..... 206/349, 372–379; D3/276, 282; 312/902; 220/768, 771

See application file for complete search history.

(56) References Cited

U.S. PATENT DOCUMENTS 1,761,453 A * 6/1930 Rankin ..... B25H 3/02 312/902
2,594,304 A * 4/1952 Nelson ..... B65D 71/0007 220/771
3,618,749 A * 11/1971 Vaccaro ..... B25H 3/02 206/372

(Continued)

FOREIGN PATENT DOCUMENTS

CA 1222224 A * 5/1987 ..... B25H 3/02

*Primary Examiner* — Bryon Gehman

(74) *Attorney, Agent, or Firm* — Caeden Drayton; Adan Ayala

(57) ABSTRACT

According to an embodiment, a toolbox includes a housing, one or more drawers received in the housing, and a handle extending from the housing. The handle comprises a pair of spaced grasping surfaces connected by a central grasping surface, the spaced grasping surface and the central grasping surface each spaced from the housing. According to another embodiment, a toolbox includes a housing and one or more drawers slidably received in the housing. The one or more drawers each comprise an integral latch, and the housing comprises an integral latch receptacle. Closing the drawer of the toolbox with a first amount of force does not engage the integral latch with the latch receptacle, while closing the drawer of the toolbox with a second amount of force automatically engages the integral latch with the latch receptacle, securing the one or more drawers within the housing.

30 Claims, 12 Drawing Sheets

(56) References Cited

U.S. PATENT DOCUMENTS

| | | | | | |
|---|---|---|---|---|---|
| 4,058,210 | A * | 11/1977 | Mitchell | B25H 3/02 | 206/372 |
| 4,294,348 | A * | 10/1981 | Hastings | A45C 11/24 | 206/373 |
| 4,768,651 | A * | 9/1988 | Lanius | A01K 97/06 | 206/373 |
| 4,991,711 | A * | 2/1991 | Cheng | B44D 3/121 | 206/372 |
| 5,426,885 | A * | 6/1995 | Wittman | A01K 97/06 | 312/902 |
| 7,225,939 | B2 * | 6/2007 | Casscles | B65D 1/0223 | 220/771 |
| 7,823,991 | B2 * | 11/2010 | Purdy | A47B 67/04 | 312/902 |
| 9,227,316 | B2 * | 1/2016 | Stevens | B25H 3/022 | |

* cited by examiner

MULTIFUNCTIONAL TOOLBOX

This application claims the benefit of U.S. Provisional Application Ser. No. 62/049,588, entitled "Toolbox," which is incorporated by reference in its entirety herein.

FIELD OF THE INVENTION

The present invention relates generally to toolboxes.

BACKGROUND OF THE INVENTION

Toolboxes having drawers often include numerous components associated with extending and retracting the drawers, including slides, wheels, ball bearings, tracks, and so on. Among other things, the present application relates to an improved toolbox with drawers which can selectively latch to the toolbox housing to secure the drawers for transport of the toolbox.

SUMMARY OF THE INVENTION

According to one aspect of this disclosure, a toolbox includes a housing, one or more drawers received in the housing, and a handle extending from the housing. The handle comprises a pair of spaced grasping surfaces connected by a central grasping surface, the spaced grasping surface and the central grasping surface each spaced from the housing.

According to another aspect of this disclosure, a toolbox includes a housing and one or more drawers slidably received in the housing. The one or more drawers each comprise an integral latch, and the housing comprises an integral latch receptacle. Closing the drawer of the toolbox with a first amount of force does not engage the integral latch with the latch receptacle, while closing the drawer of the toolbox with a second amount of force automatically engages the integral latch with the latch receptacle, securing the one or more drawers within the housing.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only, and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Features of toolboxes in accordance with one or more embodiments are shown in the drawings, in which like reference numerals designate like elements. The drawings form part of this original disclosure in which.

DETAILED DESCRIPTION OF THE ILLUSTRATED EMBODIMENT(S)

Figure 1:
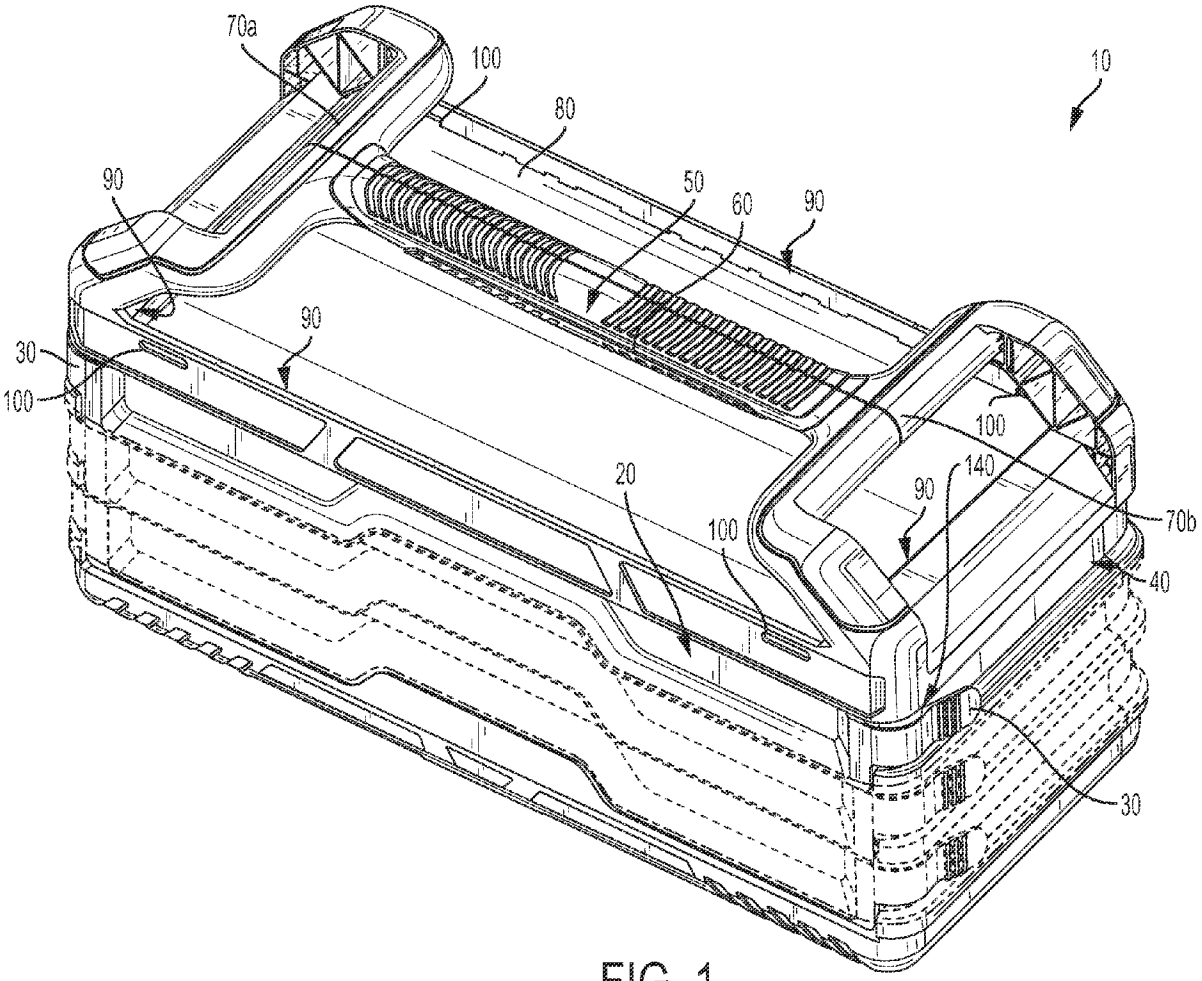
FIG. 1 illustrates a top perspective view of a toolbox according to an aspect of the present disclosure.

FIG. 1 illustrates an embodiment of a toolbox 10 having one or more drawers 20 selectively received therein. It may be appreciated that the one or more drawers 20 may be of a variety of sizes (e.g., depths). In the illustrated embodiment, the toolbox 10 includes three drawers 20 of uniform depth, but it may be appreciated that the number and sizes of the drawers may vary across embodiments. In an embodiment, each drawer 20 includes a pair of latches 30 which may be configured to lock the drawers 20 from movement relative to a housing 40 of the toolbox 10.

As shown in FIG. 1, the toolbox 10 may include a handle 50 extending over an upper surface of the toolbox 10. In an embodiment, the handle 50 may be generally H-shaped, providing both a central grasping surface 60 generally configured to be held by a single hand (or both hands held adjacent to one another), and spaced grasping surfaces 70 (individually grasping surfaces 70*a* and 70*b*) so that a user may hold the toolbox 10 by the handle 50, with both arms positioned with the palms of the hands face one another. Accordingly, it may be appreciated that the alternate carrying arrangements associated with either the central grasping surface 60 or the spaced grasping surfaces 70 may facilitate either light duty carrying (e.g., configured for one-hand hold) or heavy duty carrying (e.g., configured for two-hand hold). In addition, in an embodiment where the central grasping surface 60 is positioned perpendicular to the spaced grasping surfaces 70, the handle 50 may either be used with two hands held laterally adjacent to one another, or two hands held perpendicular to the direction of elongation of the toolbox 10. In an embodiment, the handle 50 may be configured to provide a fully circumferentially enclosed grip area, such that the grip area is formed from rounded and finished surfaces, and that there are no exposed edges or unfinished regions in the grip area. As described in greater detail below, where the housing 40 is formed from multiple components, unfinished edges on each component may face one another at the handle 50, so as to cover the unfinished edges on each component, so that the grip area of the handle 50 is circumferentially enclosed.

In an embodiment the housing 40 of the toolbox 10 includes one or more external storage areas. For example, in the illustrated embodiment the toolbox 10 includes a top tray 80 over which the handle 50 extends. It may be appreciated that the housing 40 may be configured so a raised lip 90 surrounds the top tray 80, so as to prevent objects placed in the top tray 80 from sliding off of the top tray 80 (and off of the toolbox 10). In an embodiment, the raised lip 90 may include one or more drains 100 formed therein, configured so that if the toolbox 10 is left in the rain, or is otherwise exposed to liquid, the liquid will not accumulate in the top tray 80, but may drain out of the drains 100 instead of forming a pool of the liquid.

Figure 2:
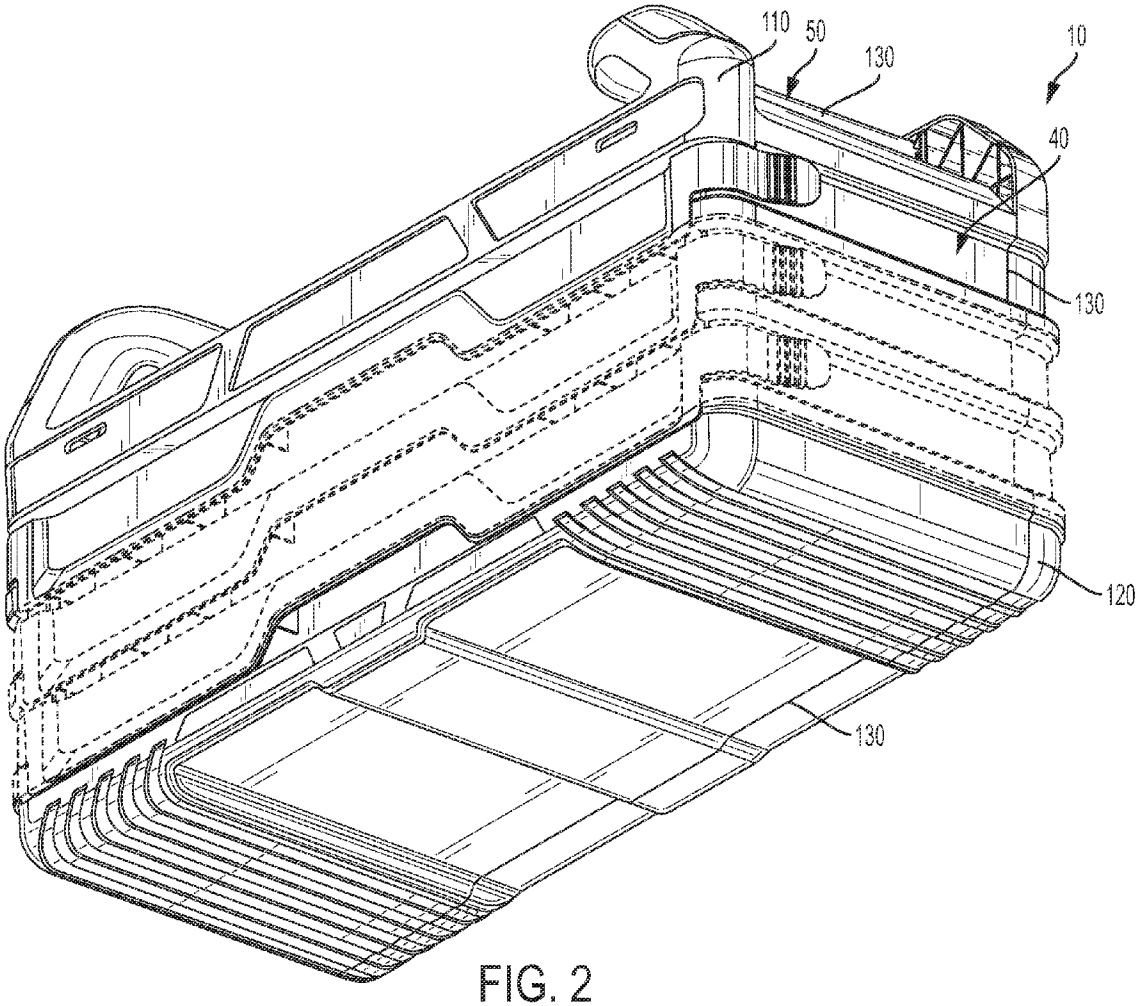
FIG. 2 illustrates a bottom perspective view of the toolbox of FIG. 1.

FIGS. 2-7 illustrate other views of the toolbox 10. For example, FIG. 2 illustrates a bottom perspective view. As may be seen more clearly in the bottom perspective view, the housing 40 may include a first component 110 and a second component 120, which may be joined at a seam 130 therebetween. As discussed in greater detail below, in an embodiment the seam 130 may generally be offset from the center of the toolbox 10 (e.g., towards the rear of the toolbox 10, away from the front of the toolbox 10 where the drawers 20 extend). In an embodiment, the seam 130 may be the boundary between sides of the toolbox 10 and the rear wall of the toolbox 10. In an embodiment, the seam 130 may divide the handle 50 into equal halves, e.g., along the central grasping surface 60, as described below.

Figure 3:
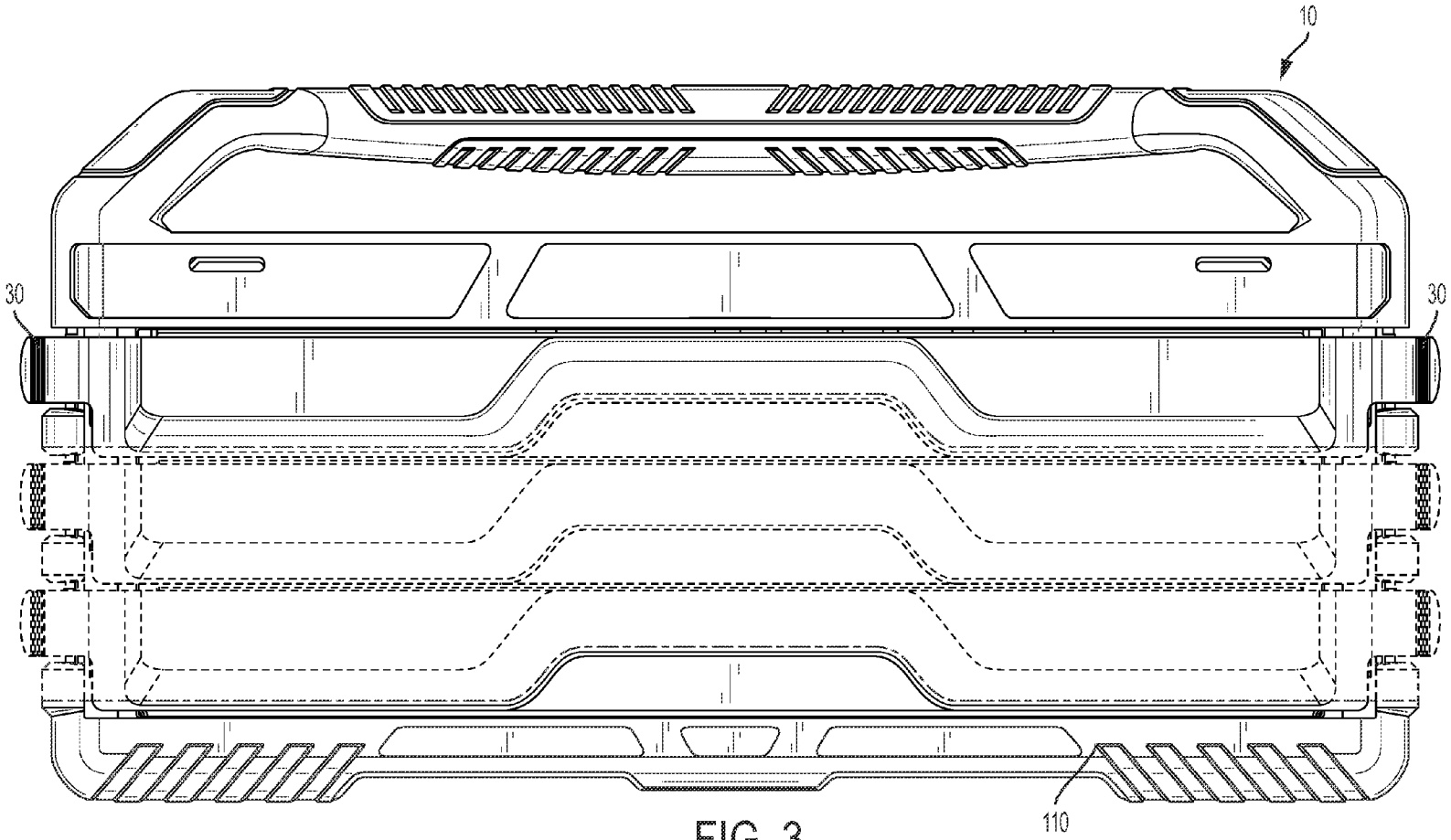
FIG. 3 illustrates a front view of the toolbox of FIG. 1.
Figure 4:
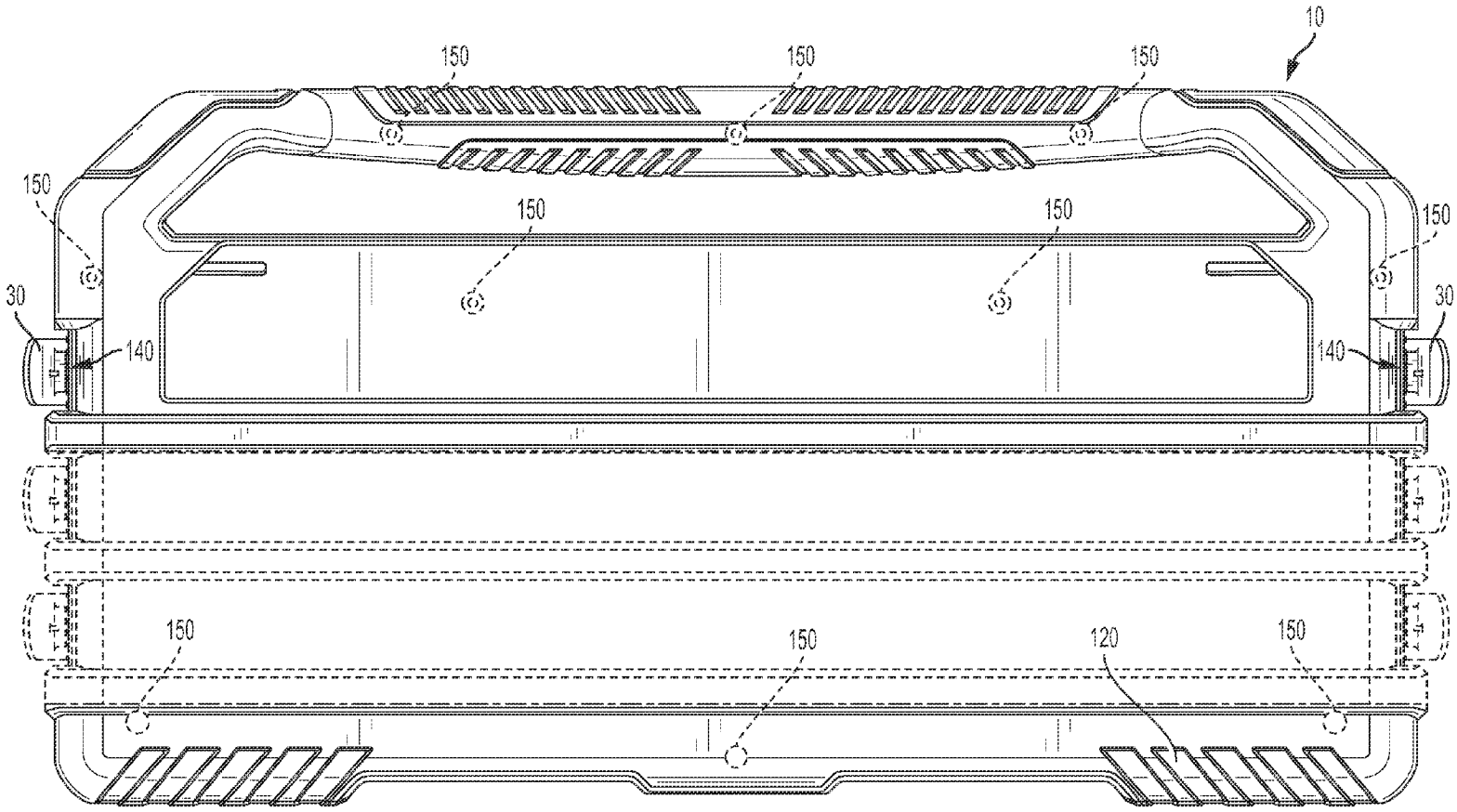
FIG. 4 illustrates a rear view of the toolbox of FIG. 1.

As shown in the front view of the toolbox 10 in FIG. 3, and the rear view of the toolbox 10 in FIG. 4, the latches 30 may be configured to extend into latch receptacles 140 formed on the sides of the toolbox 10. The engagement of the latches 30 and the latch receptacles 140 is described in greater detail below. As shown, in an embodiment the latch receptacles 140 may be recessed in sides of the toolbox 10. It may be appreciated that such recessions may protect latches 30 and the latch receptacles 140 from impacts (e.g., if the toolbox 10 were dropped). The rear view of FIG. 4, showing the second component 120, additionally illustrates apertures for fastener connections to secure the second component 120 to the first component 110. It may be appreciated that in other embodiments other connections between the first component 110 and second component 120 may be utilized, including but not limited to snap fit connections, adhesives, welding, press fitting, seaming, or so on.

Figure 5:
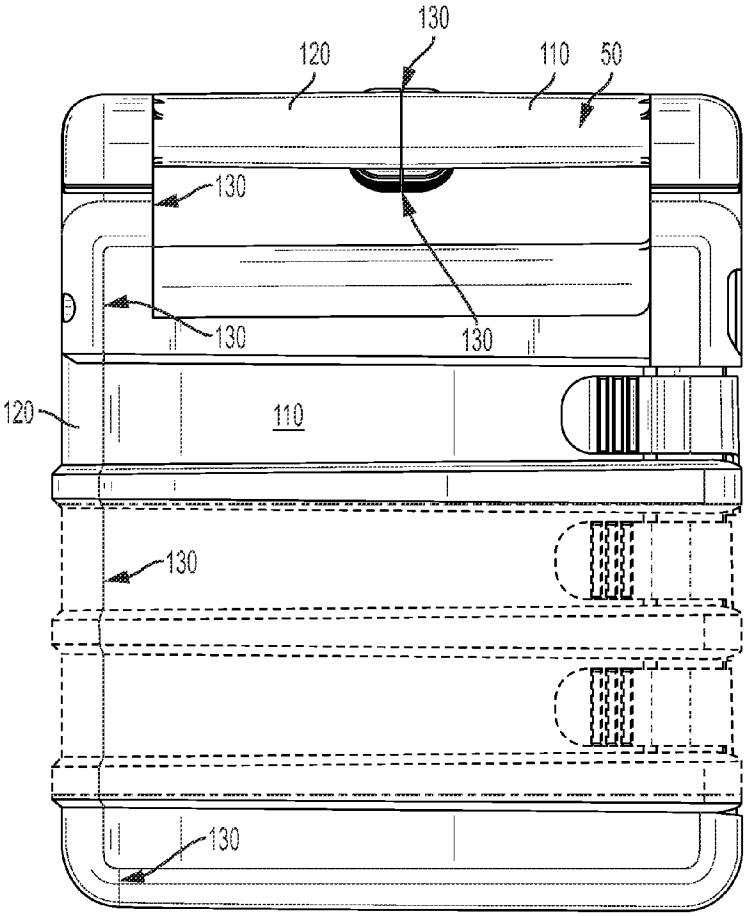
FIG. 5 illustrates a side view of the toolbox of FIG. 1.
Figure 6:
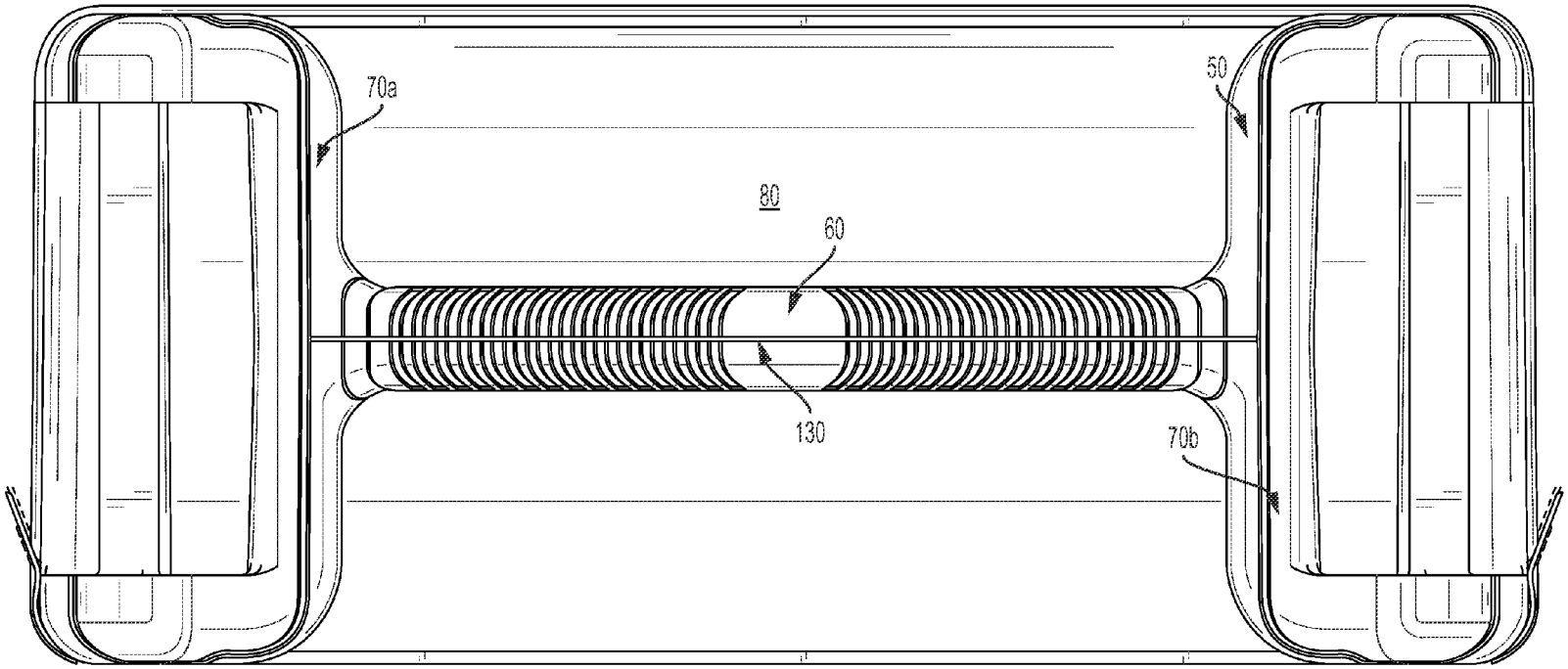
FIG. 6 illustrates a top view of the toolbox of FIG. 1.
Figure 7:
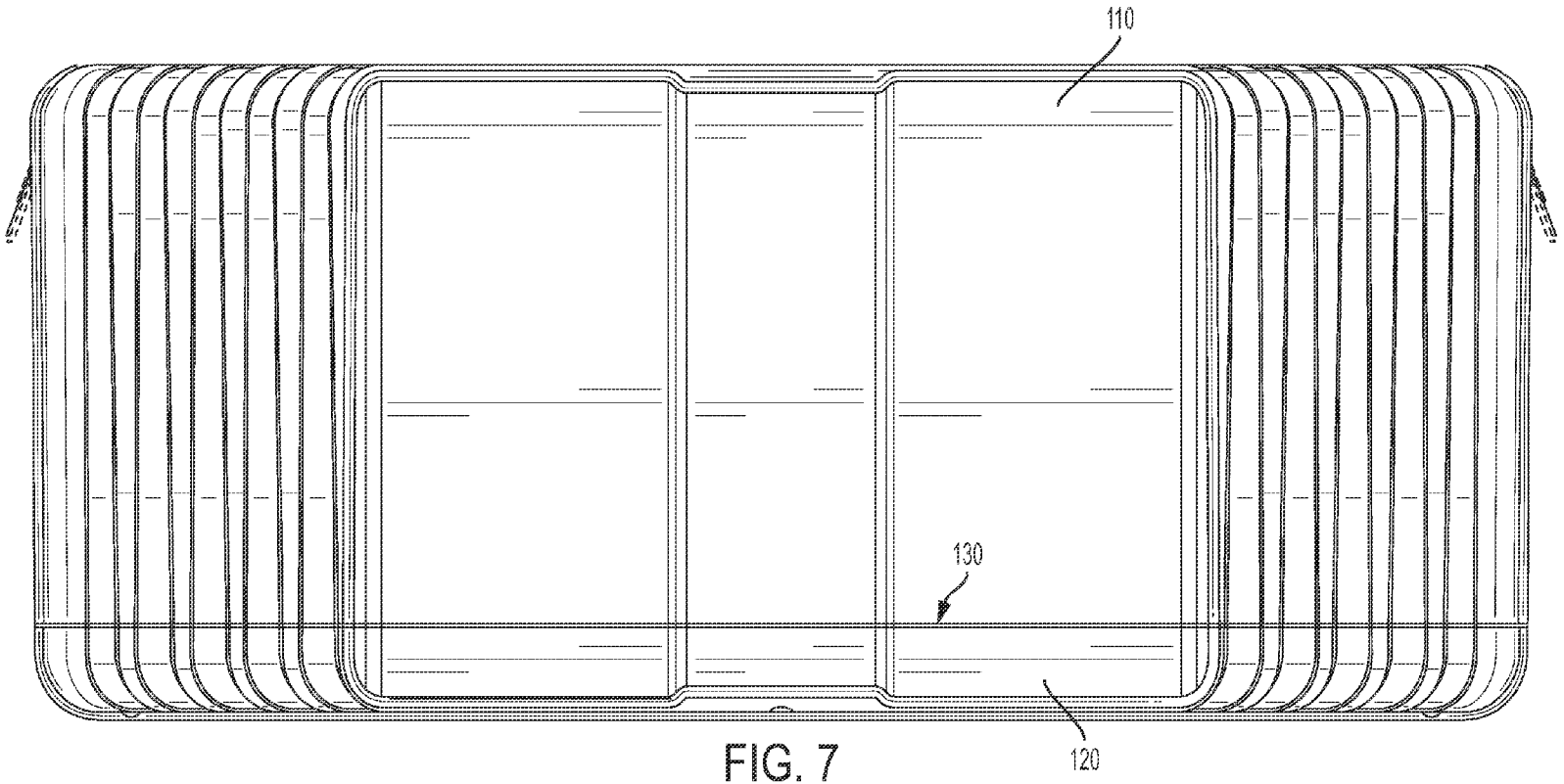
FIG. 7 illustrates a bottom view of the toolbox of FIG. 1.

The side view of FIG. 5 further illustrates the seam 130 between the first component 110 (e.g., in the illustrated embodiment including the front, sides, top, and bottom of the housing 40, as well as the associated forward half of the handle 50) and the second component 120 (in the illustrated embodiment including the rear of the housing 40, as well as the associated rear half of the handle 50). The central positioning of the seam 130 separating the first component 110 and the second component 120 at the handle 50 can also be seen in the top view of FIG. 6, while the off-center path of the seam 130 outside of the handle 50 can be seen in the bottom view of FIG. 7.

Figure 8:
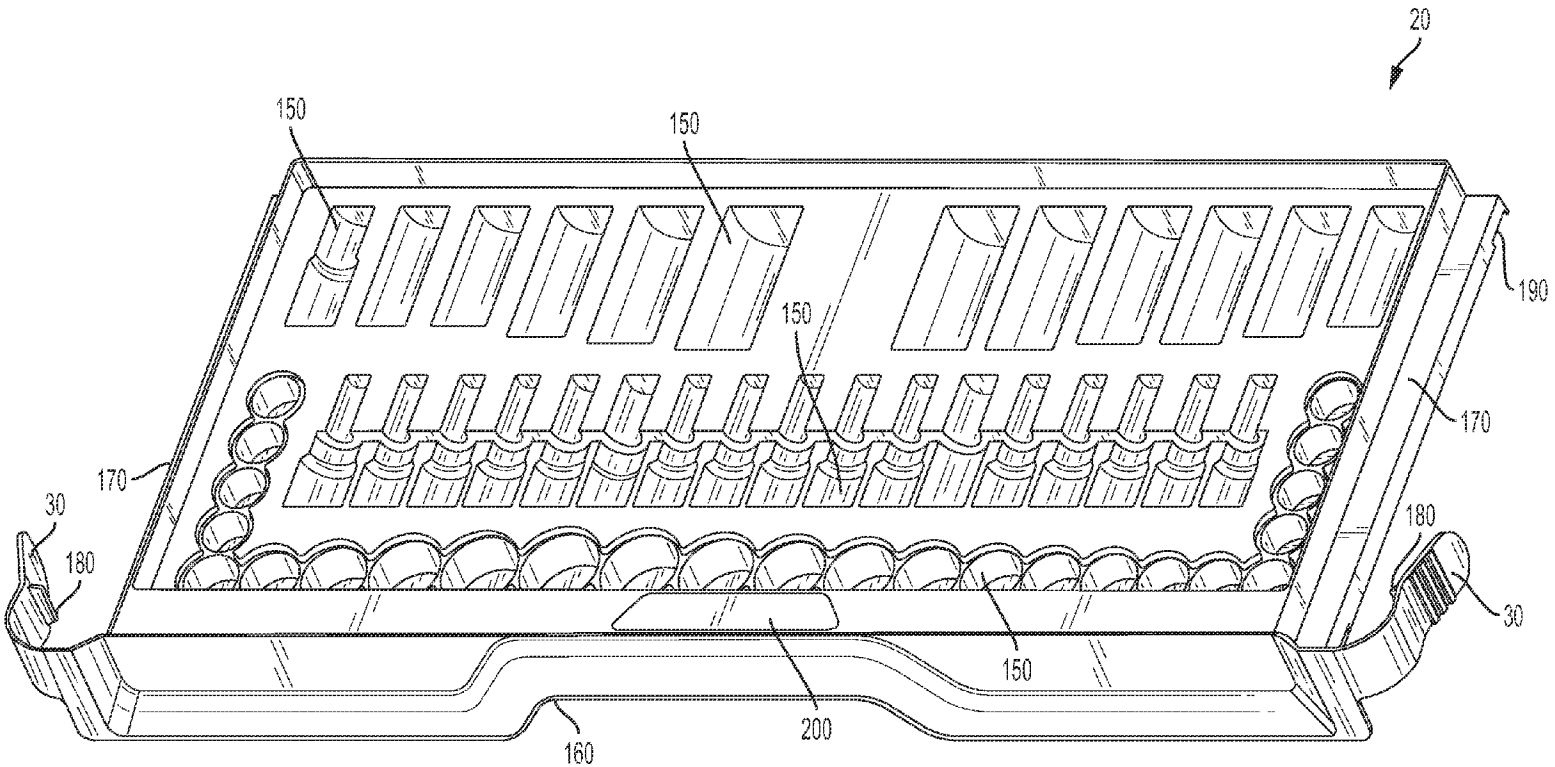
FIG. 8 illustrates an isolated top perspective view of an embodiment of a drawer of the toolbox of FIG. 1.

FIG. 8 illustrates an isolated top perspective view of an embodiment of the drawer 20. In an embodiment, the drawer 20 may be configured as a unitary component (e.g., integrally molded or formed). For example, in an embodiment, the drawer 20 may be formed from a single piece of molded plastic. While in some embodiments the drawer 20 may comprise a generally flat tray region, in other embodiments, such as that illustrated, the drawer 20 may include receptacles 150 configured to receive specific sizes and shapes of tools. In an embodiment, the toolbox 10 may be packaged with the tools that fit into the receptacles 150. For example, in the illustrated drawer 20, the receptacles 150 are shaped to receive ratchet set bits. It may be appreciated that other drawers 20 may be configured to receive in receptacles 150 ratchet tools, screwdrivers, bit drivers, pliers, hammers, snips, or so on. In an embodiment, the drawer 20 may include one or more tray regions therein (e.g., compartments to hold loose items).

As further shown in the embodiment of the drawer 20 of FIG. 8, the drawer 20 may further include a drawer handle 160 (which in some embodiments may be centrally located on the drawer 20), drawer slides 170 (configured to slide along associated rails in the housing 40 of the toolbox 10), the latches 30 (including locking tabs 180 thereon, as described below). As shown, the drawer slides 170 may include at ends thereof drawer stops 190, which may comprise recesses configured to engage with complementary engagements on the housing 40 of the toolbox 10, to prevent or deter inadvertent removal of the drawer 20 from the housing 40.

As indicated above, the drawer 20 may include receptacles 150 associated with particular tools. In an embodiment, each of a plurality of drawers 20 may comprise different receptacles, and may be otherwise differently configured from one another. As shown in FIG. 8, in some embodiments a drawer label 200 may be provided on the drawer 20, which may identify the contents of that drawer 20. In an embodiment, the drawer label 200 may be molded integrally with the drawer 20, while in other embodiments, the drawer label 200 may be affixed to the remainder of the drawer 20 (e.g., as a label). In an embodiment the outer faces of the drawer 20 may be comprised of a texture or material that facilitates marking or scribing. In an embodiment, the drawer handle 160 may be recessed from the bottom of the drawer 20, which may facilitate grasping the drawer handle 160 (e.g., to pull the drawer 20 out from the housing 40 of the toolbox 10). The recession of the drawer handle 160 may also facilitate viewing the drawer label 200 of the subsequent drawer 20 in the toolbox 10.

Figure 9:
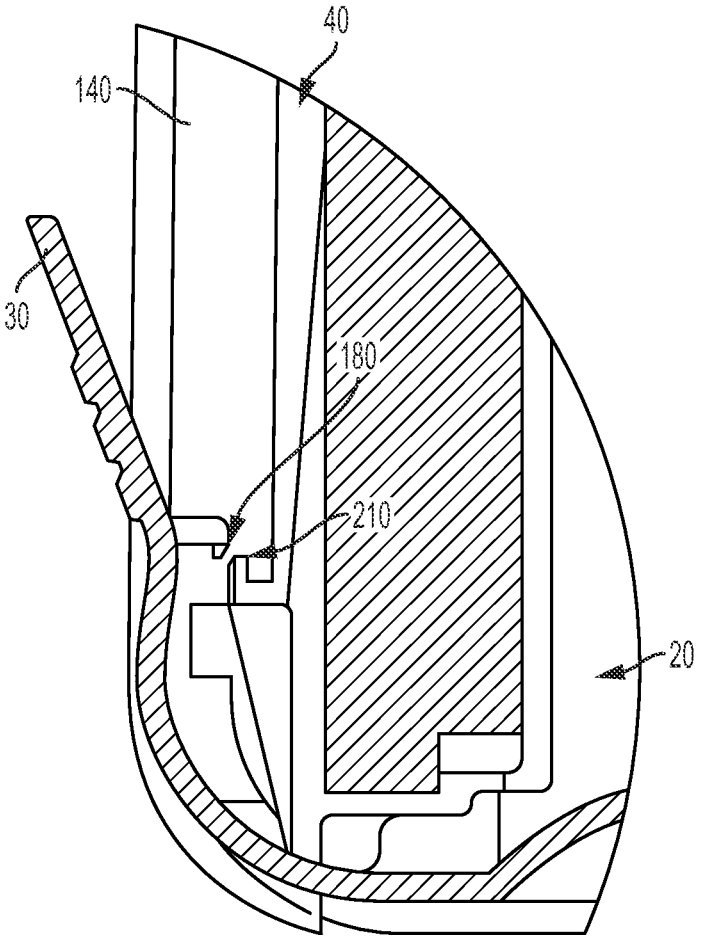
FIG. 9 illustrates an engagement between a latch of the drawer and a latch receptacle on the housing of the toolbox.

As indicated above, the locking tab 180 of the latch 30 may selectively engage with the housing 40 of the toolbox 10 so as to lock one or more of the drawers 20 into the housing 40. As shown in FIG. 9, when the drawer 20 is received in the housing 40, the latch 30 may generally align with a drawer lock engagement area 210 in each latch receptacle 140 of the housing 40. It may be appreciated that in an embodiment the latch 30 may be formed of a pliable and/or resilient material, and may be generally biased in a position that does not engage the locking tab 180 with the drawer lock engagement area 210. Accordingly, sliding the drawer 20 gently into the housing 40 may generally not engage the locking tab 180 with the drawer lock engagement area 210, and thus the drawer 20 may be easily slid into and out of the housing 40 of the toolbox 10. In an embodiment, sliding the drawer 20 into the housing 40 with a greater force may cause the latch 30 to automatically press inward towards the center of the toolbox 10, and thus may cause the locking tabs 180 to engage with the drawer lock engagement area 210 in the latch receptacle 140. Such forces may vary across embodiments, but as an example, in one embodiment the lesser amount of force, which does not cause automatic locking, may be less than 10 lbs, while the greater amount of force, causing automatic locking, may be 10 or more lbs of force (e.g., between 10 lbs of force to 25 lbs of force, inclusive). It may be understood to one of ordinary skill in the art that such automatic engagement may be actuated based on surface deformations on portions on one or more of the drawer 20 and the housing 40. For example, one may appreciate that surfaces of one or more of the drawer 20 and the housing 40 may interfere and deform (e.g., based on material selections thereof) to act as a planar spring, such that the drawer 20 can be over-inserted into the housing 40, resulting in the integral latch 30 automatically engaging with the drawer lock engagement area 210 when the drawer 20 is inserted in the housing 40 with the greater force. The amount of surface deformation associated with automatically locking may vary across embodiments. For example in an embodiment, the surface deformation associated with either the drawer or the housing may be in the range greater than 0.001" and less than 0.5" from their non-deformed positions. Such deformation may in some embodiments be in both the drawer and the housing, such that the sum total deformation across both the drawer and the housing is in the range greater than 0.001" and less than 0.5" from their non-deformed positions. The surface deformations and the surfaces of the drawer 20 and/or the housing 40 that act as the planar spring(s) may vary across embodiments (and may depend on the amount and direction of force applied when closing the drawer 20), and as such, the surface deformations may vary across the plane(s) that act as the planar spring(s). It may also be appreciated that in some embodiments, manually pressing on the latches 30 when the drawer 20 is fully inserted in the housing 40 of the toolbox 10 may cause the locking tab 180 to slide over the drawer lock engagement area 210 in the latch receptacle 140, locking the drawer 20 in place relative to the housing 40 of the toolbox 10.

Accordingly, it may be appreciated that in an embodiment of the toolbox 10, the drawers 20 may lock in place into the housing 40 with integrated locking mechanism formed from the engagement of the locking tabs 180 of the latches 30 and the drawer lock engagement areas 210 of the housing 40. It may be appreciated that the locks integrated into the drawers 20 may act perpendicular to the path of motion of the drawers 20 to securely lock the drawers 20 into the housing 40 of the toolbox 10. In an embodiment, the locks act independently from one another, such that each drawer 20 can be locked or unlocked from the toolbox 10 on their own. It may be appreciated that to unlock a drawer 20 from the housing 40, a user may pull the latches 30 outwards away from the center of the toolbox 10, so that the locking tabs 180 disengage from the drawer lock engagement areas 210, allowing sliding movement of the drawer 20 out from the housing 40 of the toolbox 10.

Figure 10:
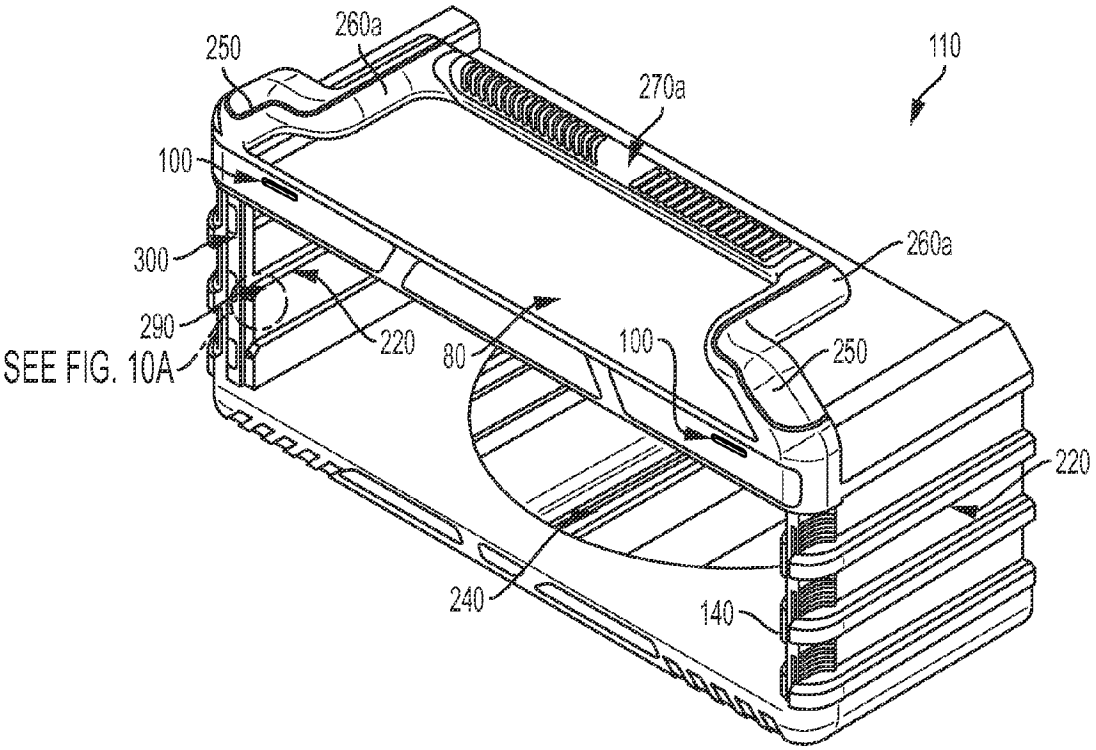
FIG. 10 illustrates an isolated perspective view of a first portion of the housing of the toolbox of FIG. 1, and an enlargement thereof.
Figure 10A:
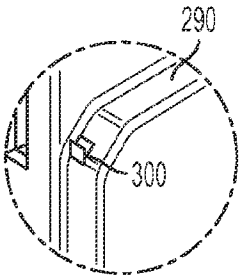
Figure 11:
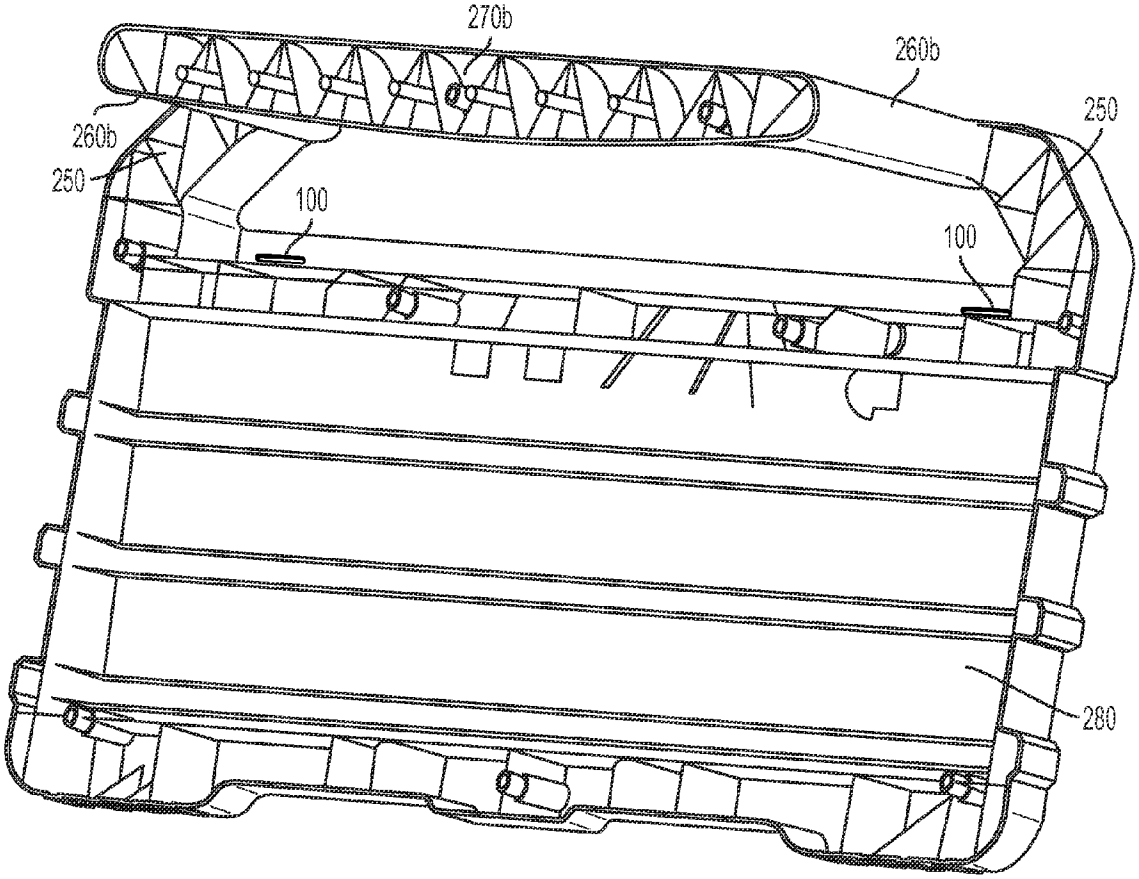
FIG. 11 illustrates an isolated perspective view of a second portion of the housing of the toolbox of FIG. 1.

As indicated above, in an embodiment, the housing 40 of the toolbox 10 is formed from a first component 110 and a second component 120, joined at the seam 130. FIG. 10 illustrates an embodiment of the first component 110 in isolation, while FIG. 11 illustrates an embodiment of the second component 120 in isolation. As shown, in an embodiment the first component 110 includes the top tray 80, sides 220 (including the latch receptacles 140), and bottom 240 of the housing 40. As further shown, a pair of handle supports 250 extend from the corners of the opening of the housing 40, extend over the top tray 80, and extend towards a center line of the toolbox 10 formed when the first component 110 is assembled with the second component 120. Accordingly, the handle supports 250 on the first component 110 extend into first halves 260*a* of the spaced grasping surfaces 70, which are then connected by a first half 270*a* of the central grasping surface 60. As shown in FIG. 11, the rear wall 280 of the housing 40 may be formed in the second component 120, along with a pair of handle supports 250 that extend towards second halves 260*b* of the spaced grasping surfaces 70, which are connected by the second half 270*b* of the central grasping surface 60. Accordingly, when the first component 110 and the second component 120 are joined, the first halves 260*a* of the spaced grasping surfaces 70 and the first half 270*a* of the central grasping surface 60 aligns with the second halves 260*b* of the spaced grasping surfaces 70 and the second half 270*b* of the central grasping surface 60 (at the seam 130), to form the spaced grasping surfaces 70 and the central grasping surface 60.

As noted above, and as visible in FIG. 10, it may be appreciated that the interior of the housing 40 of the toolbox 10 may include integral rails 290 on which the drawer slides 170 of the drawer 20 may slide to extend the drawer 20 into and out of the housing 40. As further illustrated, and enlarged in Detail A, a drawer stop engagement 300 may be provided in the housing 40, and may be configured to engage with the drawer stop 190 on the drawer 20, preventing or deterring the unintentional complete separation of the drawer 20 from the housing 40 of the toolbox 10. In an embodiment, dipping or tilting the drawer 20 relative to the housing 40 when the drawer stop 190 is at the drawer stop engagement 300 may allow the drawer 20 to be removed completely from the housing 40.

Figure 12:
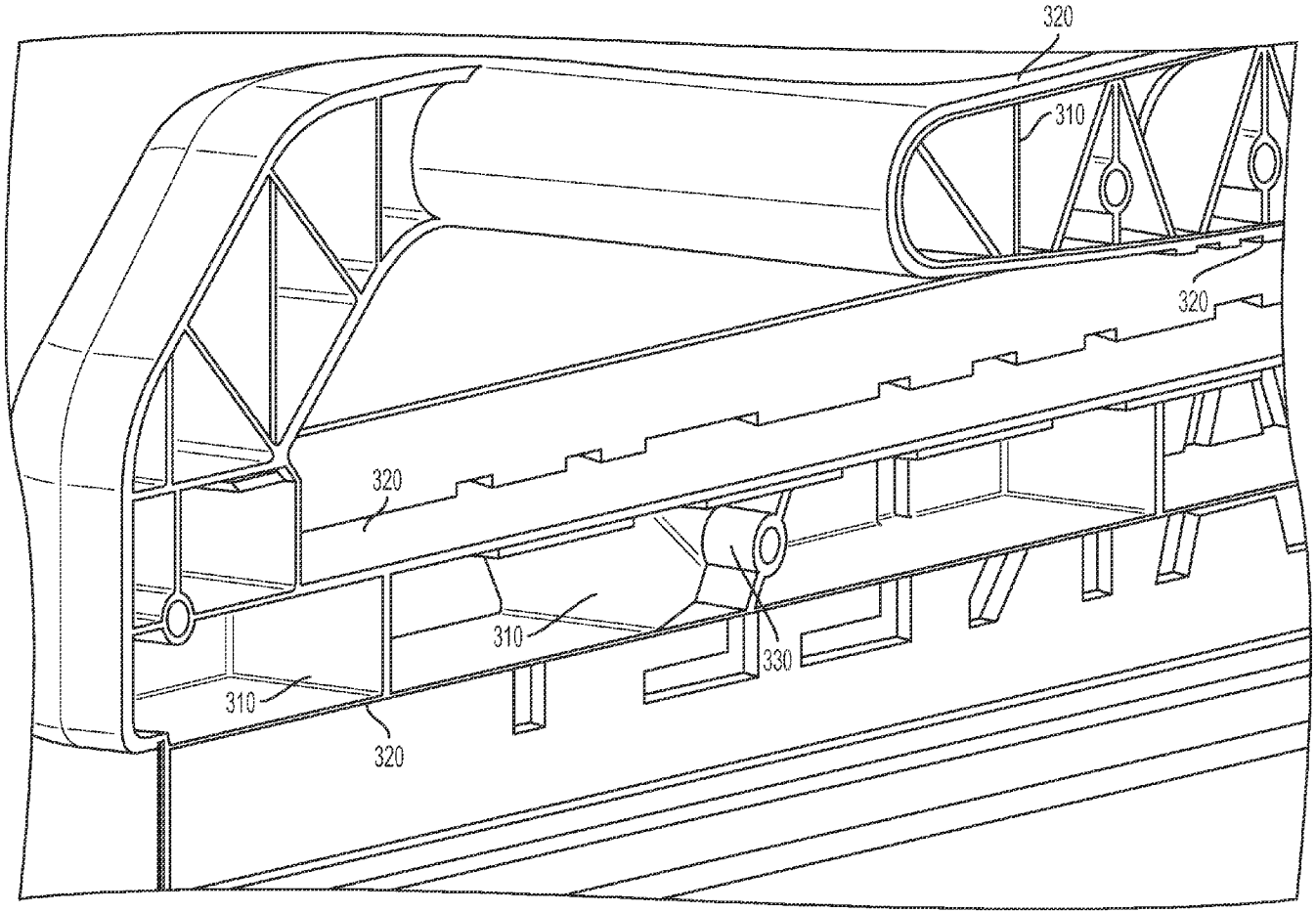
FIG. 12 illustrates an enlargement of the second portion of the housing of the toolbox of FIG. 1, illustrating interior wall segments and exterior wall segments thereof.

It may be appreciated from the figures that in an embodiment the walls of the toolbox 10 may generally include a honeycomb or multi-wall shell configuration. For example, as illustrated in FIG. 12, interior wall segments 310 may separate exterior wall segments 320 that make up each wall of the housing 40 of the toolbox 10. Such interior wall segments 310 may distribute forces (e.g., loads from the tools in the toolbox 10, impact forces to the toolbox 10, or so on) to increase the durability of the toolbox 10, without greatly increasing the overall weight of the toolbox 10. In an embodiment, the arrangement of interior wall segments 310 within the exterior wall segments 320 may be positioned to eliminate areas of structural weakness that would otherwise exist. As indicated above, in some embodiments the handle 50 may be configured so that the central grasping surface 60 and spaced grasping surfaces 70 are fully enclosed. Accordingly, it may be appreciate that in an embodiment interior wall segments 310 may be obscured by exterior wall segments 320 at the handle 50 (where the interior wall segments 310 open towards the seam 130).

As further shown in FIG. 12, in an embodiment lead-in members 330 formed on one or more of the first component 110 and the second component 120 may be configured to align the first component 110 and the second component 120 when assembling the housing 40 of the toolbox 10. In an embodiment, such as that illustrated, the lead-in members 330 may include apertures and/or receptacles for fasteners (e.g., screws), so as to fix the first component 110 to the second component 120. As noted above, it may be appreciated that other securement mechanisms may be used in other embodiments, including but not limited to snap fit connections, adhesives, welding, press fitting, seaming, or so on, each of which may work in conjunction with lead-in members 330 in various embodiments.

Accordingly, in the illustrated embodiment, where the housing 40 is formed by the first component 110 and the second component 120 secured together, such a low-component configuration provides increased durability by reducing the number of components that may fail (e.g., 'slidably engaged' components and any other detachable components) over time or when receiving impact forces, while still providing the ability to lock the drawers 20 in a closed position due to the integrated locking mechanism formed in the engagement between the one-piece drawer 20 and two-piece housing 40. As the latches 30 wrap around a portion of housing 40, the locking mechanism is further protected from impact forces to the toolbox 10.

While the illustrated embodiment of the toolbox 10 may be configured as a plastic injection molded toolbox with one or more removable drawers, which may also be plastic injection molded, it may be appreciated that the components described herein may be of different constructions or configurations, including but not limited to one or more being comprised of different material choices. For example, the components described herein may each be constructed from a variety of materials, including but not limited to one or more plastics, metals, rubbers, elastomers, or any other appropriate material choice. For example, in an embodiment one or more of the components may be formed of aluminum (e.g., machined aluminum), iron (e.g., steel), or any other appropriate material. In some embodiments, the material choices may differ from component to component.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A toolbox comprising:

a housing;

one or more drawers received in the housing;

at least one lip surrounding at least part of one or more trays, wherein the at least one lip surrounding an upper surface of the housing and includes at least one drain; and a handle extending from the housing, wherein the handle comprises a pair of spaced grasping surfaces connected by a central grasping surface, the spaced grasping surfaces and the central grasping surface each spaced from the housing.

2. The toolbox of claim 1, wherein the handle extends from a top of the housing.

3. The toolbox of claim 1, wherein the one or more drawers are slidably received in the housing.

4. The toolbox of claim 1, wherein the spaced grasping surfaces are generally parallel to each other, and generally perpendicular to the central grasping surface.

5. The toolbox of claim 1, wherein the pair of spaced grasping surfaces connected by a single central grasping surface.

6. The toolbox of claim 1, wherein the housing comprises a first component and a second component secured together at a seam.

7. The toolbox of claim 6, wherein the handle is integral to the housing, and wherein portions of the first component and the second component together form the central grasping surface of the handle.

8. The toolbox of claim 7, wherein the central grasping surface is fully circumferentially enclosed.

9. The toolbox of claim 1, wherein the housing comprises integral rails on which the one or more drawers slide.

10. The toolbox of claim 1, wherein the one or more drawers are each integrally formed with drawer slides configured to slide on rails in the housing.

11. The toolbox of claim 1, wherein the one or more drawers each comprise at least one integral latch configured to secure the one or more drawers to the housing of the toolbox.

12. The toolbox of claim 11, wherein the latch comprises a locking tab configured to selectively engage with a drawer lock engagement area of the housing.

13. The toolbox of claim 12, wherein closing a drawer of the one or more drawers of the toolbox with a first amount of force does not engage the integral latch with the drawer lock engagement area, while closing the drawer of the toolbox with a second amount of force automatically engages the integral latch with the drawer lock engagement area.

14. The toolbox of claim 13 wherein an interference between the drawer and the housing, wherein a surface of one or more of the drawer and the housing acts as a planar spring allowing the drawer to be over-inserted into the housing with a resultant surface deformation therein, resulting in engaging the integral latch with the drawer lock engagement area.

15. The toolbox of claim 14 wherein the surface deformation associated with either of the drawer and the housing, or summed across both of the drawer and the housing, is greater than 0.001" and less than 0.5".

16. The toolbox of claim 14 wherein the first amount of force is less than 10 lbs and the second amount of force is greater than or equal to 10 lbs but less than 25 lbs.

17. The toolbox of claim 14 wherein the surface deformation of the surface acting as the planar spring varies throughout the plane.

18. The toolbox of claim 1, wherein the toolbox contains an external storage area adjacent to a face of the housing containing one or more drainage areas therein.

19. The toolbox of claim 1, wherein the housing comprises a multi-wall or honeycombed structure.

20. A toolbox comprising:

a housing;

at least one lip surrounding at least part of one or more trays; and one or more drawers received in the housing;

wherein the one or more drawers each comprise an integral latch, and the housing comprises an integral latch receptacle, the integral latch receptacle including one or more recessed regions; and wherein closing the drawer of the toolbox with a first amount of force does not engage the integral latch with the integral latch receptacle, while closing the one or more drawers of the toolbox with a second amount of force automatically engages the integral latch with the integral latch receptacle, securing the one or more drawers within the housing.

21. The toolbox of claim 20, wherein the housing comprises integral rails on which the one or more drawers slide.

22. The toolbox of claim 20, wherein the one or more drawers are each integrally formed with drawer slides configured to slide on rails in the housing.

23. The toolbox of claim 20, wherein the integral latch comprises a locking tab configured to selectively engage with a drawer lock engagement area of the housing.

24. The toolbox of claim 20, wherein the integral latches engage with the housing in recessed regions of the housing.

25. The toolbox of claim 20, further comprising a handle extending from the housing.

26. The toolbox of claim 25, wherein the handle comprises a pair of spaced grasping surfaces connected by a central grasping surface, the spaced grasping surface and the central grasping surface each spaced from the housing.

27. The toolbox of claim 26 wherein the housing and the handle are formed from a first component secured to a second component, wherein portions of the first component and the second component together form the central grasping surface of the handle.

28. The toolbox of claim 27, wherein the central grasping surface is fully circumferentially enclosed.

29. The toolbox of claim 20, wherein the housing and the drawer comprise injection molded plastic.

30. A toolbox comprising:

a housing;

one or more drawers received in the housing; and at least one lip surrounding a portion of the upper area of the housing, the at least one lip including at least one drain; and a handle extending from the housing;

wherein the handle is generally H-shaped and comprises a pair of spaced grasping surfaces connected by a central grasping surface, the spaced grasping surfaces and the central grasping surface each spaced from the housing.

* * * * *